United States Patent [19]

Dirks

[11] Patent Number: 4,541,630

[45] Date of Patent: Sep. 17, 1985

[54] WRITING INSTRUMENT WITH RANDOM NUMBER SELECTOR

[75] Inventor: Johann H. Dirks, No. Yonkers, N.Y.

[73] Assignee: JHD Holding, Ltd., Yonkers, N.Y.

[21] Appl. No.: 667,564

[22] Filed: Nov. 2, 1984

Related U.S. Application Data

[63] Continuation-in-part of Ser. No. 584,760, Feb. 29, 1984, abandoned.

[51] Int. Cl.[4] ..... A63F 3/06; B43K 29/00; G07C 15/00

[52] U.S. Cl. ..... 273/144 B; 401/195

[58] Field of Search ..... 273/144 B; 401/195

[56] References Cited

U.S. PATENT DOCUMENTS

| | | | |
|---|---|---|---|
| 2,512,168 | 6/1950 | Moore | 401/195 X |
| 3,343,293 | 9/1967 | Kirklen | 401/195 X |
| 4,368,887 | 1/1983 | Gamble | 273/144 B |
| 4,403,775 | 9/1983 | Chaput | 273/144 B |
| 4,465,278 | 8/1984 | Messina et al. | 273/144 B |

FOREIGN PATENT DOCUMENTS

| | | | |
|---|---|---|---|
| 57554 | 8/1982 | European Pat. Off. | 401/195 |
| 2400738 | 4/1979 | France | 273/144 B |
| 121801 | 12/1918 | United Kingdom | 273/144 B |

*Primary Examiner*—Paul E. Shapiro

*Attorney, Agent, or Firm*—Karl F. Milde, Jr.

[57] ABSTRACT

A writing pen, particularly a retractable ball point pen, is formed with two random number selectors to provide a multiple game play. The game and pen construction is integrally cooperatively formed for ready manufacture and use.

13 Claims, 5 Drawing Figures

FIG. 1
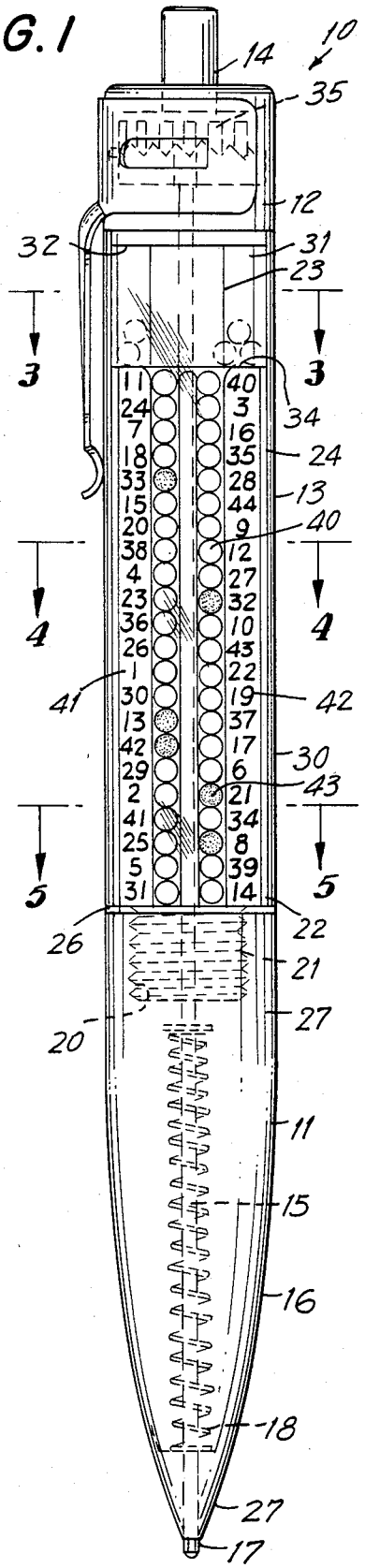
FIG. 2
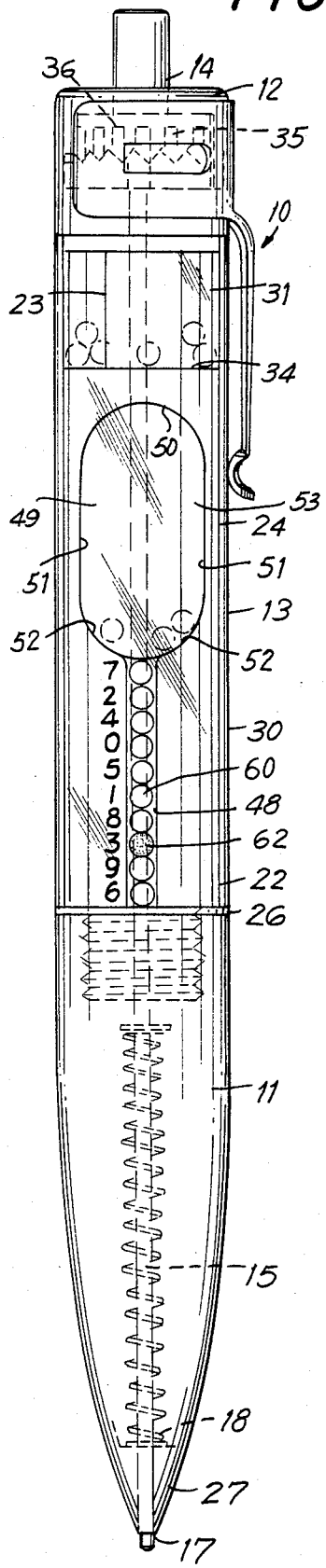
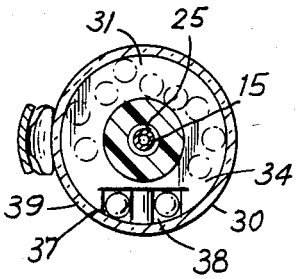
FIG. 3
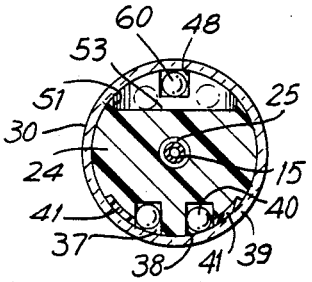
FIG. 4
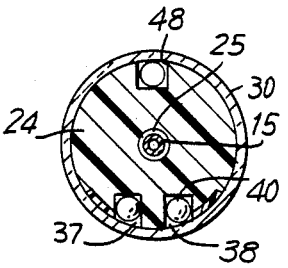
FIG. 5

WRITING INSTRUMENT WITH RANDOM NUMBER SELECTOR

RELATED U.S. PATENT APPLICATIONS

This application is a continuation-in-part application of U.S. Ser. No. 584,760, filed Feb. 29, 1984, now abandoned.

FIELD OF THE INVENTION

This invention relates to random number selectors. More specifically, this invention relates to random number selectors specifically useful in playing various lottery type games in combination with a retractable pen.

BACKGROUND AND DISCUSSION OF THE PRIOR ART

Various random number selector devices are known in the prior art.

Prior art gaming devices generally involved a single plurality of balls falling into a single slot, such as is disclosed in Sussman, U.S. Pat. No. 3,289,321; Bartholomew, U.S. Pat. No. 2,185,366 and Nord, U.S. Pat. No. 2,799,506.

Attempts were made to provide multiple simultaneous random number selectors, but these required a single reservoir to simultaneously serve several selection slots, such as disclosed in Ratnagur, British Pat. No. 121,801; Gamble, U.S. Pat. No. 4,368,887; and Chaput, U.S. Pat. No. 4,403,775. This use of a common reservoir of a single pool was not satisfactory for playing two distinct games with the constant odds for each game being played.

Attempts to provide separate selecting mechanisms as shown in French Pat. No. 1,030,506 to Lederman were difficult constructions to manufacture and used either a common reservoir or non-simultaneously play dual reservoir.

French Publication No. 2 400 738 to Quenderff sought to combine a pen with a mechanical random number selector. Here again, a single pool was employed, and the construction did not lend itself to multiple simultaneous game play. In addition, the pen aspect was limited to simple non-retractable pen designs only.

Now there is provided by the present invention a retractable pen-random number selector, wherein the random number selector provides two different number selectors for simultaneous play from distinct, separate number pools and combines same in a retractable ball pen construction. Yet the aforesaid is achieved with ease of manufacture.

It is noted that the present invention provides novel simultaneous play of a multiple simultaneous number lottery games.

BRIEF DESCRIPTION OF THE DRAWINGS

FIG. 1 is a front vertical partial fragmentary, elevational view of the invention;

FIG. 2 is a rear vertical partial fragmentary, elevational view of the invention;

FIG. 3 is a sectional view taken along line 3—3;

FIG. 4 is a sectional view taken along line 4—4; and

FIG. 5 is a sectional view taken along line 5—5.

SUMMARY OF THE INVENTION

A writing pen having two random number selectors formed as part of a pen device wherein part of the structure forms or houses both the pen actuation elements and the random selector elements. The invention is particularly embodied as a retractable refill ball point pen, wherein the pen actuation and random selector elements are integrally cooperatively formed.

DESCRIPTION OF THE PREFERRED EMBODIMENT

Referring to the figures, there is shown the pen-random number selector invention generally referred to as 10. The invention 10 is generally formed of a body 11, a cover 12, number selector portion 13, pen actuation portion 14 and ball refill 15.

Body 11 is formed with a tapered, contoured outer surface 16, and a bottom portion 27 with orifice 17, and spring retaining internal surface 18 for holding refill 15 so that ball point 19 extends downwardly from orifice 17. Internal threads 20 are formed to engage threads 21 of central member 22 for disengagement from bottom portion 27 for pen refill replacement purposes. Metal retention ring 26 completes the engagement of member 22 with body portion 27. Central member 22 is formed with an upper cylindrical portion 23 and a larger diameter lower cylindrical portion 24, and a central through hole 25 for guidingly receiving the upper portion of refill 15. Ball pen retraction elements 35 are retained in cover 12 at 36 in the well-known manner.

A transparent cylindrical plastic sleeve 30 closely engages and encompasses cylindrical portion 24, while being spaced from upper cylindrical portion 23 so as to form reservoir 31 between sleeve 30, portion 23, lower wall 32 and lower cylindrical upper wall portion 34. Two slots or grooves 37 and 38 are formed in the peripheral wall 39 of portion 24, and communicate with reservoir 31. A plurality of forty-four plastic balls 40 are sized to be received in slots 37 and 38 in equal rows of twenty-two balls each. The numbers "1 to 44" are imprinted in random order in two equal rows 41 and 42, adjacent slots 37 and 38 respectively. Six of the balls 43 (typically) are differently colored. In shaking the pen, the balls 40 will be randomly dispersed in reservoir 31 and upon the pen being turned upright, the balls gravitationally rest in the slots 37 and 38 so that the dark balls "select" six numbers for lottery play.

Lower cylindrical portion 24 is also formed with vertical slot 48 which communicates with enlarged recess 49, but does not communicate with reservoir 31. Upper arcuate wall 50, spaced parallel vertical walls 51, and arcuate walls 52 and bottom wall 53 define reservoir or recess 49. A plurality of ten plastic balls 60, with one ball 62 being differently colored, is sized to be disposed in slot 48. Thus in shaking or inverting the pen, balls 50 are randomly mixed in reservoir 49 and upon upright holding of the pen, balls 50 rest in slot 48 for "selection" of a single number, for "pick-one" or sequentially "pick-four" number selection.

Thus, there is shown a novel multiple simultaneous random number selector device, where two games are played simultaneously.

It is also important to note that the multiple simultaneous lottery game construction provides for ready combination with a refill type ball pen. When the refill must be replaced it can be readily achieved without affecting the game construction. And the game construction is more useful to the user in having an operable pen always readily available to mark the lottery cards. Thus the single instrument provides combined functions with a readily manufactured design.

Numerous variations of the invention hereinbefore described will become apparent. The invention is not confined to a strict conformity with the showing of the drawings, but may be changed or modified so long as such changes or modifications make no material departure form the salient features of the invention as herein described.

What is claimed is:

1. A retractable ball point number game pen, comprising:

(a) a substantially cylindrical pen body tapering from an upper end to a narrower lower end;

(b) a central member having a substantially cylindrical lower portion and a substantially cylindrical upper portion of smaller diameter than said lower portion, said lower portion being coaxially coupled to said upper end of said pen body;

(c) a substantially cylindrical transparent sleeve surrounding said central member, said upper portion and said sleeve defining, between them, an annular first reservoir;

(d) a substantially cylindrical upper end member coaxially coupled to said upper portion of said central member;

(e) pen retraction actuating means disposed in an orifice extending axially through said upper end member;

(f) a ball pen refill disposed in an orifice extending axially through said pen body and said central member, one end of said refill cooperating with said actuating means so that the opposite end of said refill may be extended from and retracted into the lower end of said pen body;

(g) at least one first slot communicating with said first reservoir and extending along the surface of said lower portion of said central member;

(h) a recess formed in the surface of said lower portion of said central member, said recess and said transparent sleeve defining between them a second reservoir; and (i) at least one second slot communicating with said second reservoir and extending along the surface of said lower portion of said central member;

(j) a plurality of balls which are sized to fit and are disposed in said first and second reservoirs and said first and second slots, at least one of said balls disposed in each of said first reservoir and slot and said second reservoir and slot being visually distinguishable from the remainder of said balls; and (k) number indicia operatively associated with said slots, such that said balls provide a random indication of numbers when arranged in said slots.

2. The pen of claim 1, wherein said inside of said upper end member is formed with means for holding said actuating means.

3. The pen of claim 1, wherein said lower portion of said central member is formed with means for releasably connecting itself to said upper end of said pen body, thereby to permit replacement of said pen refill.

4. The pen of claim 3, wherein said connecting means is a screw thread.

5. The pen of claim 3, further comprising means disposed at the lower end of said lower portion of said central member for retaining said transparent sleeve on said central member when said pen body is disconnected therefrom.

6. The pen of claim 5, wherein said retaining means is a retention ring surrounding said central member just below said transparent sleeve.

7. The pen of claim 1, wherein there are at least two first slots.

8. The pen of claim 1, wherein there is one second slot.

9. The pen of claim 1, wherein said first and second slots are linear and extend parallel to the central axis of said central member.

10. The pen of claim 1, wherein said at least one of said balls comprises a plurality of said balls in said first reservoir and said first slots being a different color than the remainder of said balls therein.

11. The pen of claim 1, wherein said at least one of said balls comprises one of said balls in said second reservoir and said second slot being a different color than the remainder of said balls therein.

12. The pen of claim 1, wherein the number indicia associated with said first slots extend from 1 to a number greater than 40.

13. The pen of claim 1, wherein the number indicia associated with said second slot extends from 0 to 9.

* * * * *